US007559103B2

(12) United States Patent
Barth et al.

(10) Patent No.: US 7,559,103 B2
(45) Date of Patent: Jul. 14, 2009

(54) PATIENT REMOVAL SYSTEM

(75) Inventors: Mark E Barth, Kettering, OH (US); Gregory W Branson, Batesville, IN (US); John P Biondo, Diramt, IA (US); John W Koenig, Cincinnati, OH (US); Mitchell A Smith, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 74 days.

(21) Appl. No.: 11/735,141

(22) Filed: Apr. 13, 2007

(65) Prior Publication Data

US 2007/0180612 A1 Aug. 9, 2007

Related U.S. Application Data

(60) Continuation of application No. 11/421,557, filed on Jun. 1, 2006, now Pat. No. 7,216,378, which is a division of application No. 11/091,963, filed on Mar. 29, 2005, now Pat. No. 7,055,190.

(60) Provisional application No. 60/559,298, filed on Apr. 2, 2004.

(51) Int. Cl.
*A61G 1/013* (2006.01)
*A61G 1/044* (2006.01)
*A47C 27/10* (2006.01)

(52) U.S. Cl. ..... 5/626; 5/81.1 R; 5/706; 5/713

(58) Field of Classification Search ..... 5/625–628, 5/81.1 R, 424, 706, 710, 713, 714
See application file for complete search history.

(56) References Cited

U.S. PATENT DOCUMENTS

| | | | | |
|---|---|---|---|---|
| 1,711,167 | A | | 4/1929 | Blake |
| 2,309,464 | A | | 1/1943 | Lucci et al. |
| 3,134,110 | A | | 5/1964 | Born Barcat |
| 3,601,824 | A | | 8/1971 | Bradford |
| RE28,916 | E | * | 7/1976 | Rice et al. ..... 5/628 |
| 4,124,908 | A | | 11/1978 | Burns et al. |
| 4,186,453 | A | | 2/1980 | Burns et al. |
| 4,736,474 | A | | 4/1988 | Moran et al. |
| 5,016,299 | A | | 5/1991 | Boulanger |
| 5,050,254 | A | | 9/1991 | Murphy |
| 5,065,464 | A | * | 11/1991 | Blanchard et al. ..... 5/81.1 R |
| 5,150,487 | A | * | 9/1992 | Hemphill ..... 5/625 |
| 5,189,746 | A | | 3/1993 | Horie |
| 5,249,321 | A | | 10/1993 | Graf |
| 5,539,945 | A | | 7/1996 | Rosenberg et al. |
| 5,682,631 | A | | 11/1997 | Weismiller et al. |
| 5,729,850 | A | | 3/1998 | Eskeli |

(Continued)

FOREIGN PATENT DOCUMENTS

CA 2034727 11/1991

*Primary Examiner*—Alexander Grosz
(74) *Attorney, Agent, or Firm*—Barnes & Thornburg LLP

(57) ABSTRACT

Various embodiments of a patient removal system are provided for evacuating a patient during an emergency. The patient removal systems may be used to transport the patient while the patient is on a mattress, or the patient removal systems may be used to transport the patient without the mattress. The patient removal systems permit caregivers to transport patients out of danger or harm without requiring patient support devices to be transported along with the patients.

18 Claims, 13 Drawing Sheets

U.S. PATENT DOCUMENTS

| | | | | |
|---|---|---|---|---|
| 5,839,137 | A | 11/1998 | Butler et al. | |
| 6,053,534 | A | 4/2000 | Timmerman | |
| 6,195,822 | B1 | 3/2001 | Sorensen et al. | |
| 6,609,260 | B2 | 8/2003 | Hand et al. | |
| 6,854,628 | B1 | 2/2005 | Stehr | |
| 6,964,073 | B1 * | 11/2005 | Curry | 5/626 |
| 7,055,190 | B2 | 6/2006 | Barth et al. | |
| 7,216,378 | B2 | 5/2007 | Barth et al. | |
| 2003/0106155 | A1 * | 6/2003 | Arai | 5/627 |
| 2006/0200905 | A1 | 9/2006 | Barth et al. | |

* cited by examiner

PATIENT REMOVAL SYSTEM

This application is a continuation of U.S. patent application Ser. No. 11/421,557, filed Jun. 1, 2006, now issued as U.S. Pat. No. 7,216,378, which is hereby expressly incorporated by reference herein, which was a division of U.S. patent application Ser. No. 11/091,963, filed Mar. 29, 2005, now U.S. Pat. No. 7,055,190, which is hereby expressly incorporated by reference herein. U.S. patent application Ser. No. 11/091,963 claimed the benefit, under 35 U.S.C. § 119(e), of U.S. Provisional Patent Application No. 60/559,298 which was filed Apr. 2, 2004 and which is hereby expressly incorporated by reference herein.

BACKGROUND OF THE INVENTION

The present invention relates generally to a patient removal system for evacuating a patient during an emergency. More particularly, the present invention relates to a patient removal system for use with a patient support device such as a hospital bed.

In nursing care, hospital care, and other patient care environments where a patient is given care while confined to a patient support device such as a hospital bed or stretcher, it is sometimes necessary to evacuate the patient from the area due to an emergency. During such an emergency, if the patient support device is movable via casters or the like, the entire patient support device, bed, stretcher, or the like may be mobilized with the patient on board in order to evacuate the area.

However, on some occasions it would be easier or imperative to transport the patient without the support device. An example of such an occasion might be when the elevators are locked during a fire, and stairs must be used. Other occasions might be when the support device is secured or attached to the wall in some fashion, when there are numerous medical devices attached to the support device, when the support device doesn't have casters, or when the support device would not easily fit through the emergency escape path.

SUMMARY OF THE INVENTION

The present invention comprises one or more of the features recited in the appended claims and/or the following features which, alone or in any combination, may comprise patentable subject matter. A system is provided for removing a patient from a patient support device having a mattress that is removable from the patient support device. The system may comprise a sleeve that is configured to encompass a portion of the mattress and a patient resting on the mattress. A tightener may be coupled to the sleeve to tighten the sleeve about the mattress and the patient supported on the mattress.

A handle may be coupled to the tightener and may be movable to tighten the tightener. The tightener may be elastomeric, and may extend about some or all of the perimeter of the sleeve. The handle may be positioned adjacent the foot end of the sleeve. A cinch may also be coupled to the tightener for drawing the slack in the tightener.

The system may further comprise a lifter which may be coupled to a patient support deck on the patient support device. The lifter may be pneumatic, inflatable, mechanical, or may be of any other construction capable of lifting a portion of the mattress away from the patient support deck. The lifter can be used to move a step-deck mattress relative to a patient support deck having a step-deck construction.

The patient support deck may be able to tilt or move between a horizontal position and a reverse Trendelenburg position. In the reverse Trendelenburg position, the mattress may be more easily pulled away from the patient support deck.

The patient removal system may comprise a transporter that is movable relative to the mattress. The transporter may be inflatable. The transporter may lift the patient relative to the mattress. The transporter may have runners that extend along its length. The runners may comprise elongated tubes. The runners may comprise inflatable bladders. The runners may have a plurality of air outlets. The transporter may have a compressed air source coupled thereto, or may have an air compressor coupled thereto. The transporter may have handles. The handles may be movable to actuate the inflation of the transporter. The transporter may comprise a sheet that is configured to wrap around the patient during transport. The sheet may also be tucked under the mattress when not in use.

Additional features of the invention will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying drawings, in which.

DETAILED DESCRIPTION OF THE DRAWINGS

Figure 1:
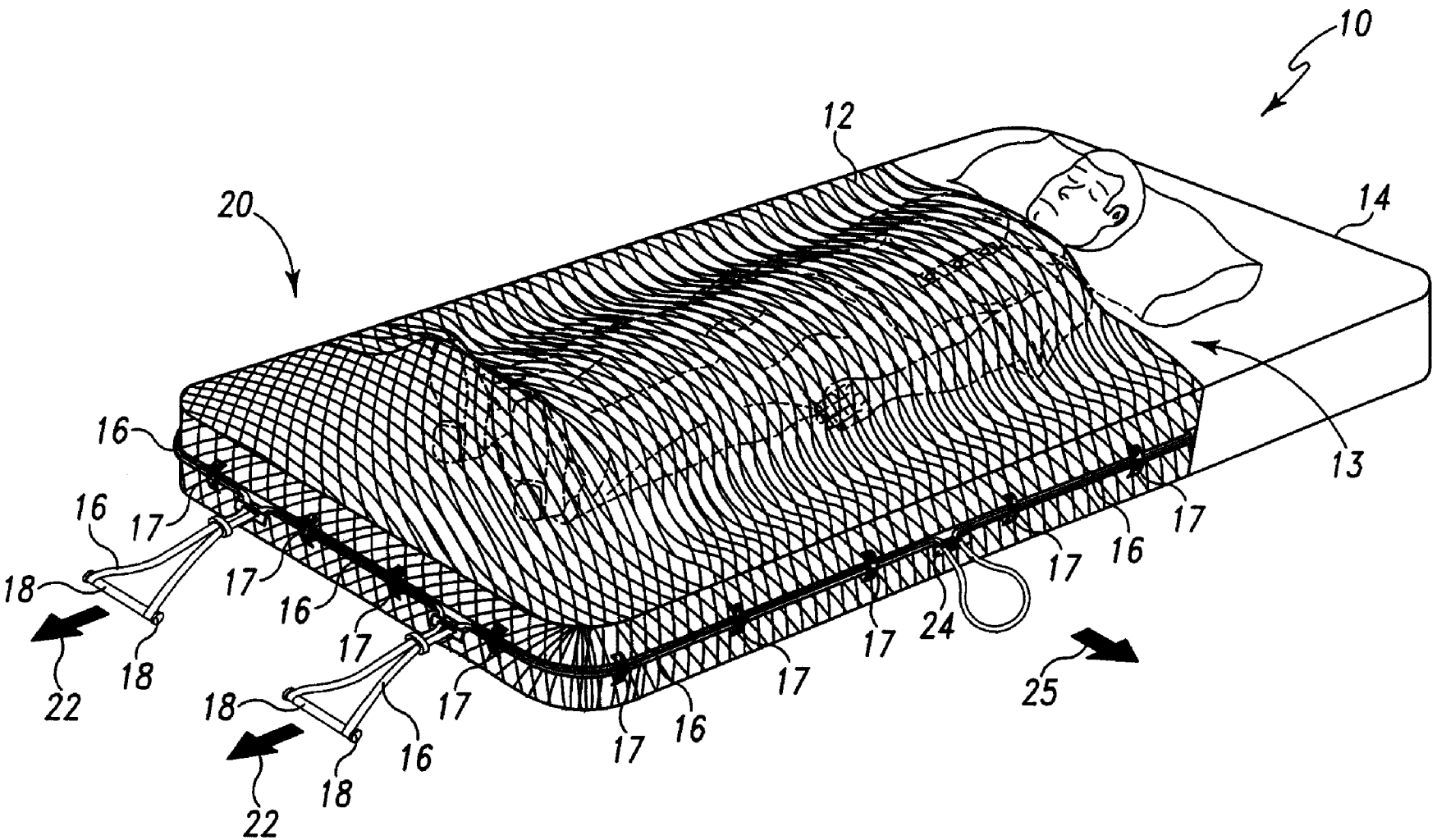
FIG. 1 is a perspective view of a mattress having a patient removal system coupled thereto to a encompass a portion of the mattress and a patient supported on the mattress.

A patient removal system 10, as shown illustratively in FIG. 1, comprises a sleeve 12 that has an opening 13 which permits the sleeve 12 to be slipped over a mattress 14 and patient resting on the mattress 14. When coupled to mattress 14 in this manner, an interior region of sleeve 12 receives a portion of the mattress and the patient therein such that the sleeve 12 encompass the portion of mattress 14, and of course, the portion of the patient resting on the mattress. Sleeve 12 is illustratively a diagonal weave fabric, a mesh, a net, or any other material that is able to be constricted around the mattress 12 and patient to hold the patient firmly against an upper surface of mattress 14. It should be understood that other materials or configurations for sleeve 12 are within the scope of this disclosure. Sleeve 12 may be part of the mattress, part of the footboard of the bed, or part of the bed deck, however, other locations and configurations for the sleeve are within the scope of the disclosure. Of course, sleeve 12 may be its own separate device.

Illustratively, a tightener 16 is coupled to a perimeter of the sleeve 12 to tighten the sleeve about the mattress 14. Tightener 16 extends along the sides and the closed end of sleeve 12. Tightener 16 is illustratively an elastomeric band or cord, however, it is within the scope of the disclosure to utilize a rope or any other material that can facilitate tightening the sleeve 12 about the mattress 14. Handles 18 are coupled to tightener 16 and are positioned at a foot end 20 of mattress 14. Handles 18 are gripped by a user and pulled in the direction indicated by arrows 22 to tighten tightener 16 and to constrict sleeve 12 around the patient and mattress 14. The constriction of sleeve 12 in this manner secures the patient firmly in place atop mattress 14. Furthermore, handles 18 may be used to lift foot end 20 of the mattress 14 off of a patient support device that is supporting the mattress 14 and to pull the mattress 14 with the patient thereon along a floor or down one of more flights of stairs.

Although the illustrative embodiment of system 10 has two handles 18, it is within the scope of this disclosure to construct patient removal system 10 with more or less than two handles 18. The force imparted on the handles 18 in directions 22 by a caregiver maintains the tension on tightener 16 and maintains the constriction of sleeve 12 around the patient and mattress during transport. A cinch 24 may also be utilized in conjunction with tightener 16 to set the pre-activation tension or the post-activation tension on tightener 16 and the strands of fabric weave of sleeve 12. Cinch 24 is configured to retain a portion of tightener 16 when such a portion of tightener 16 is pulled through cinch 24 in the direction indicated by arrow 25.

As can be seen in FIG. 1, a set of loops 17 are provided to retain tightener 16 adjacent the sides and the closed end of sleeve 12. The loops 17 may attach to a backing strip (not shown) of sleeve 12. Loops 17 illustratively guide the elastomeric band or cords through designated areas of sleeve 12. Tightener 16 may also be configured to pull the strands of the fabric weave through loops 17, thereby tightening the weave (and consequently sleeve 12) around the patient. Thus, the strands of fabric of sleeve are attached to tightener 16.

Figure 2:
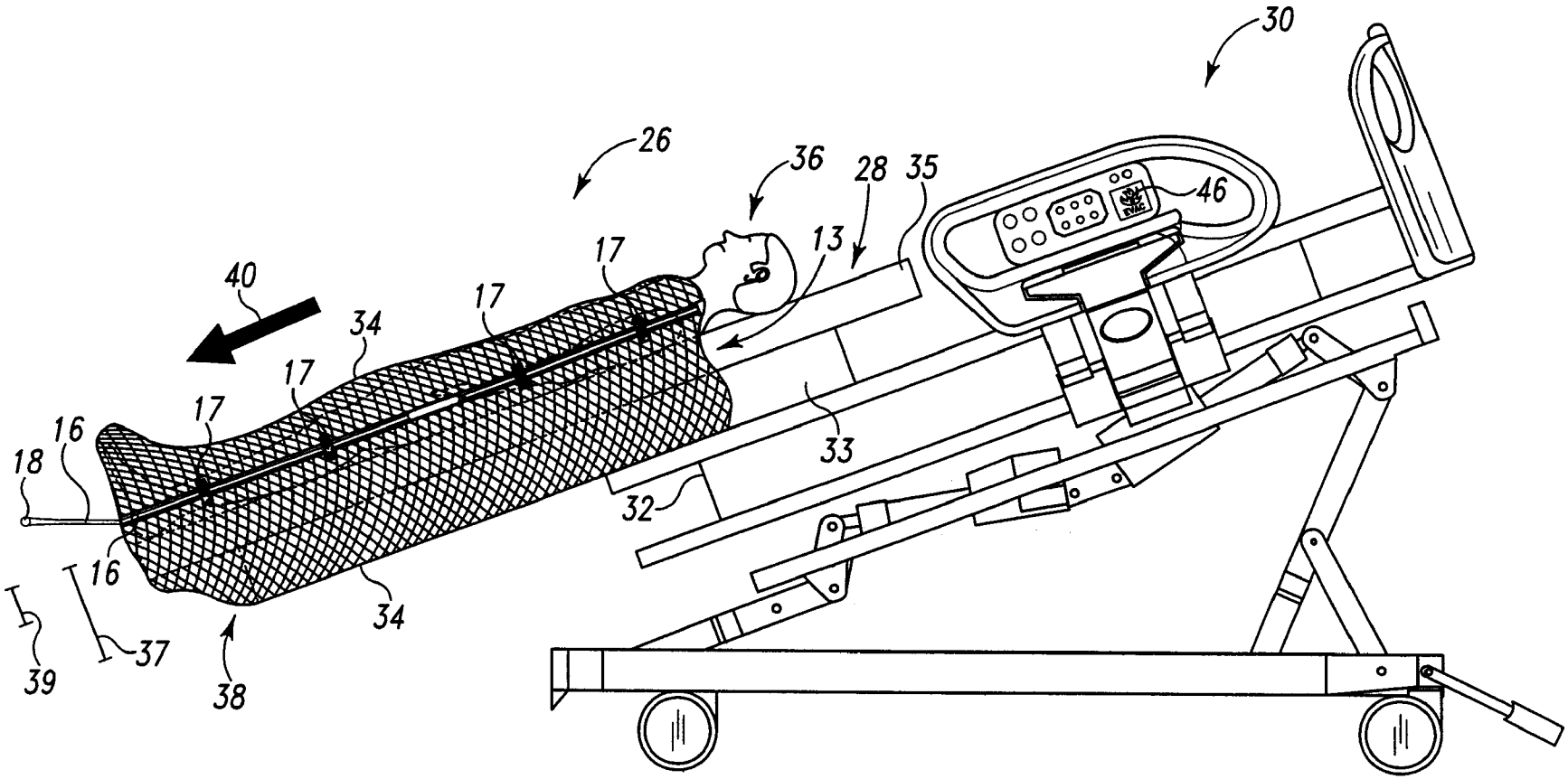
FIG. 2 is a side elevational view showing one embodiment of a patient removal system being used with a mattress supported by a step-deck of a hospital bed and showing the hospital bed in a reverse Trendelenburg position to facilitate removal from the step-deck of the mattress and a patient by the patient removal system.

FIG. 2 shows a patient removal system 26 similar to that of FIG. 1, wherein a mattress 28 is configured to fit a patient support device 30 that has a step-deck 32. Portions of system 26 that are substantially the same as like portions of system 10 are denoted with like reference numerals. Illustratively, mattress 28 is configured to mate with step-deck 32, and has a first portion 33 having a first thickness 37 and a second portion 35 having a second thickness 39 that is smaller than the first thickness 37, as can be seen in FIG. 2.

As shown in FIG. 2, sleeve 34 is configured to encompass both the patient 36 and the step-deck mattress 28. A caregiver utilizes patient removal system 26 to remove patient 36 from patient support device 30 in the following manner. A caregiver lifts handles 18, thereby tightening tightener 16 and sleeve 34 about patient 36. By lifting upwardly on handles 18, the upward force urges patient removal system 26 upwardly, causing foot end 38 of mattress 28 to lift out of step-deck 32. After foot end 38 has cleared step-deck 32, mattress 28 may be pulled in the direction indicated by arrow 40, thereby separating patient removal system 26 from patient support device 30. The reverse Trendelenberg position shown in FIG. 2 facilitates removal of the patient by reducing the distance between the foot end 38 of the mattress 28 and the floor. Furthermore, gravity helps in evacuating the patient and mattress 28 off of the bed.

A patient removal system need not necessarily envelop a portion of the mattress, but rather, may be secured over a patient with straps that engage loops formed in the side of a mattress (not shown). A tightener and/or handles may still be provided and coupled to the straps for pulling the straps to secure the patient on the mattress for patient removal.

Figure 3:
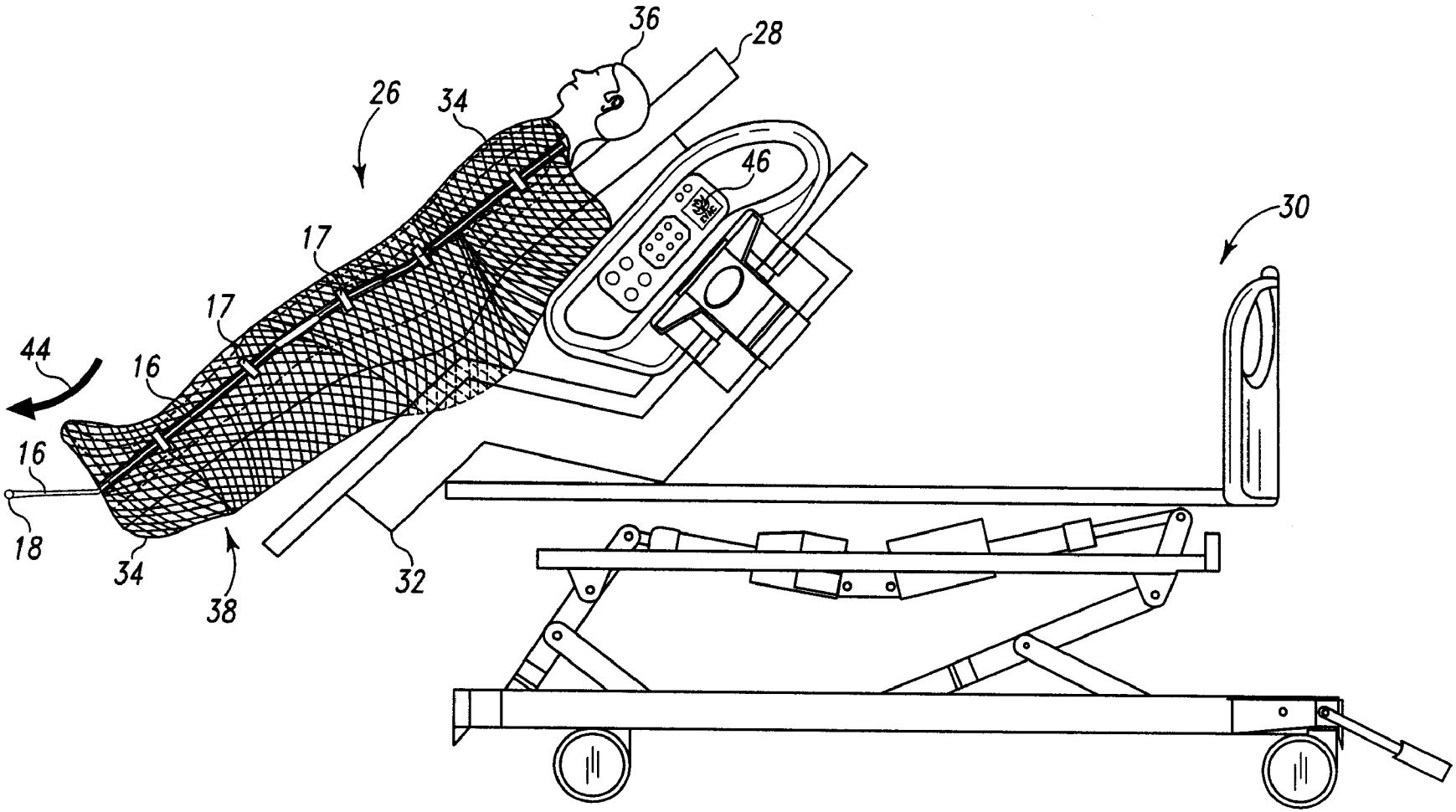
FIG. 3 is a side elevational view, similar to FIG. 2, showing the step-deck of the hospital bed moved to a chair position and showing the patient removal system being used to evacuate the mattress and patient off of the step-deck.

In an alternative arrangement, shown in FIG. 3, patient support device 30 is articulated or moved to a chair configuration which further reduces the distance between the foot end of the deck 32 and floor, thereby further facilitating removal of patient removal system 26 by pulling handles 18 in the direction indicated by arrow 44. As disclosed previously, once foot end 38 of mattress 28 is separated from step-deck 32, patient removal system 26 can be pulled away from patient support device 42 in a safe and controlled fashion. Such a chair configuration, as shown in FIG. 3, may be preprogrammed as the configuration that patient support device 30 assumes when an evacuation button 46, illustratively positioned on a side rail of the patient support device 30, is actuated. Evacuation button 46 may be actuated by being pressed by a caregiver. Evacuation button 46 may also be actuated by being automatically responsive to an emergency system such as a fire alarm or the like. It should be understood that evacuation button 46 could be positioned at other locations, including locations apart from bed 30. It should be further understood that evacuation button 46 may be omitted and bed 30 may move to the chair position automatically in response to a signal received from an emergency system.

Figure 4:
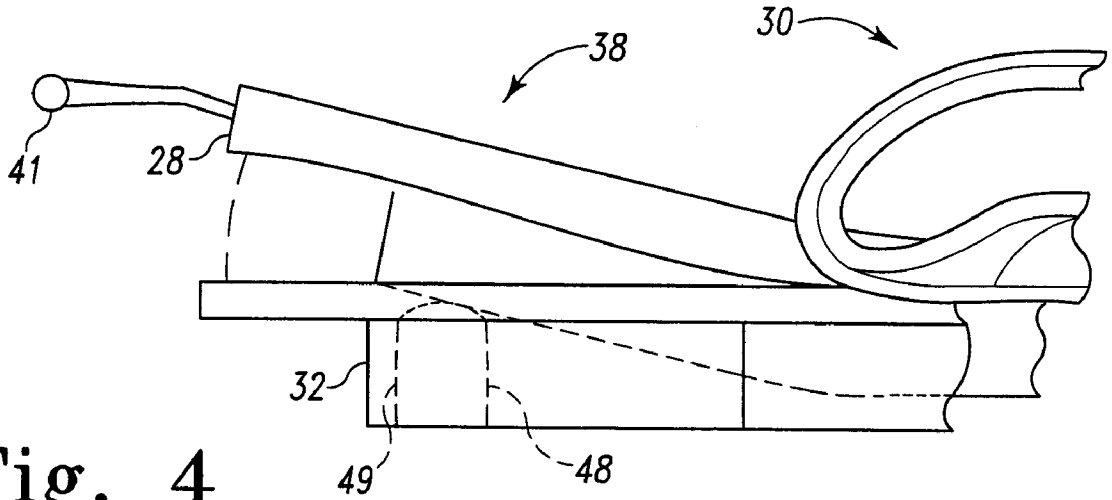
FIG. 4 is a side elevational view of a portion of a step-deck showing an inflatable lifter (in phantom) configured to lift a foot region of the mattress off of the step-deck.
Figure 5:
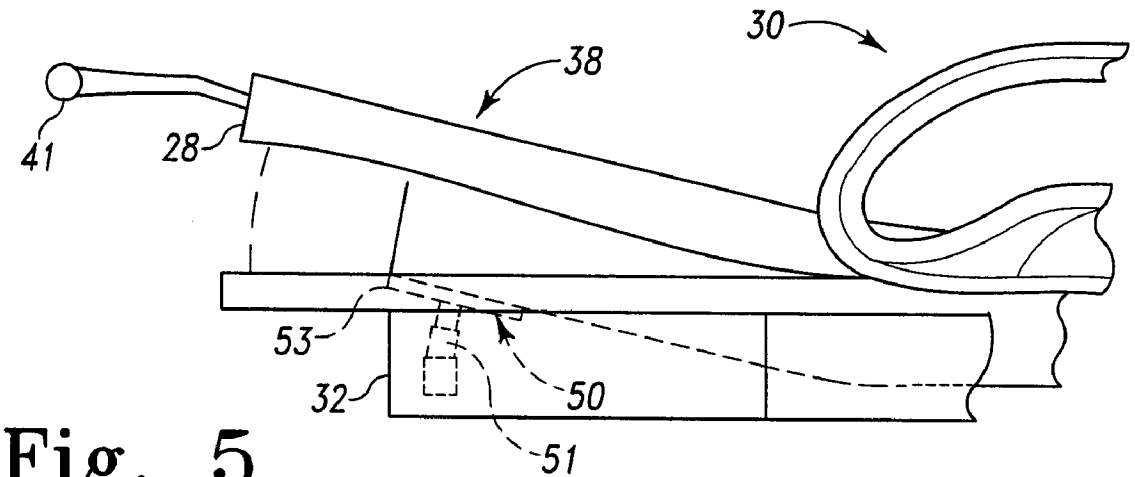
FIG. 5 is a side elevational view, similar to FIG. 4, showing a mechanical lifter configured to lift a foot region of the mattress off of the step-deck.

FIGS. 4 and 5 show alternative arrangements for an optional lifter that can be mounted to the step-deck 32 of patient support device 30. As shown in FIG. 4, an illustrative lifter 48 may comprise an inflatable bladder 49 that, when inflated, lifts foot end 38 of mattress 28 and spaces foot end 38 from step-deck 32. Upon such lifter actuation, mattress 28 may be pulled off of the patient support device by a caregiver (illustratively using handle 41) without the caregiver having to exert as much or possibly any upward pressure to lift the patient. Although patient removal systems 10 and 26 have been illustratively shown in FIGS. 1-3, it should be understood that other patient removal systems or any other manner of pulling mattress 28 away from patient support device 42 may be utilized. For example, a patient removal system could operate to remove the patient from the head end or side of the patient support device. In such embodiments, lifters may be provided at the head end or sides of an associated step-deck of a bed.

In yet another embodiment, as shown in FIG. 5, lifter 50 comprises a mechanical arm 51 and transversely extending plate 53 that is movable between a recessed position wherein foot end 38 of mattress 28 is housed within step-deck 32 and a raised position, as shown in FIG. 5, wherein foot end 38 is spaced apart from step-deck 32 of patient support device 42. As described above, any means disclosed or known in the art may be used to pull mattress 28 away from patient support device 42 once lifter 50 has been actuated. Of course systems 10, 26 may be used in conjunctions with lifters 48, 50, if desired.

Lifters 48 and 50, as seen in FIGS. 4 and 5, are illustratively actuated by button 46 which signals a processor (not shown) that signals actuation of the associated lifter 48, 50. Such a processor may interact with a blower, valving, electric motor, or any other components that collectively actuate the respective lifter 48, 50. Such a processor may be triggered by the depression of evacuation button 46, visible in FIG. 3, or it is possible that the processor is responsive to an emergency system such as a fire alarm or the like that signals to the processor when emergency patient removal is deemed necessary. The mechanical arm of lifter 50 may comprise an electromechanical actuator (such as a linear actuator), a hydraulic actuator, a pneumatic actuator, or any other type of actuator including hand operated cranking mechanisms, lead screw drives, and the like.

Figure 6:
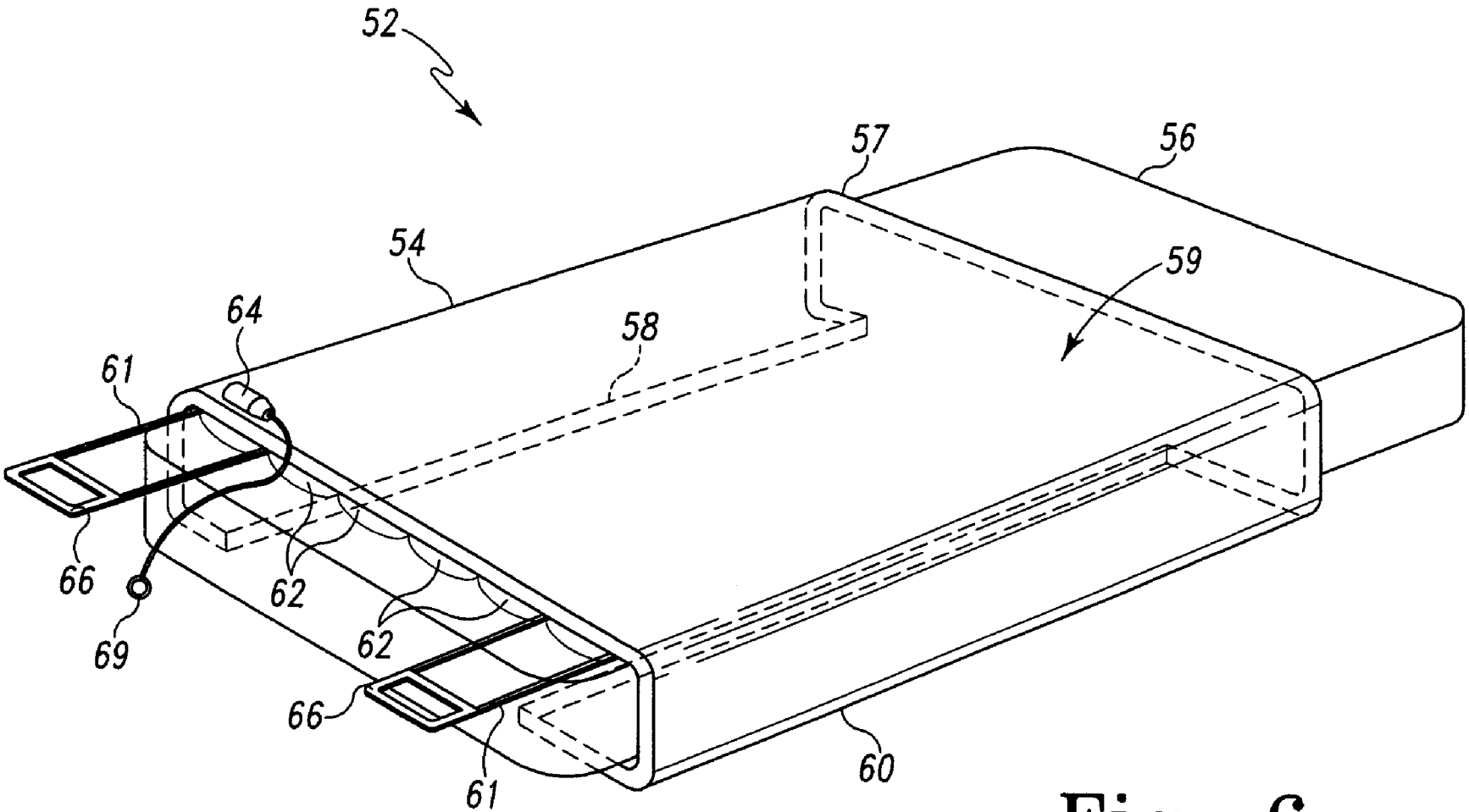
FIG. 6 is a perspective view of another embodiment of a patient removal system, showing a sheet having side extensions tucked underneath the mattress when not in use, a pair of handles at a foot end of the sheet, and a set of deflated bladders coupled to an undersurface of a middle region of the sheet.

FIG. 6 shows another embodiment of a patient removal system 52 that comprises a transporter 54 which is configured to wrap around a mattress 56. Transporter 54 has a sheet 57 and a set of bladders 62 coupled to a central region 59 of an undersurface of sheet 57. Illustratively, sheet 57 has flaps 58, 60 extending from each side of the central region 59 that can be tucked underneath mattress 56 as shown in FIG. 6. However, flaps 58,60 are illustratively short enough so as to be easily untucked from underneath mattress 56. Illustratively, flaps 58, 60 are sufficiently short so that both untuck automatically when the bladders 62 of transporter 56 are inflated, as described further herein.

Figure 7:
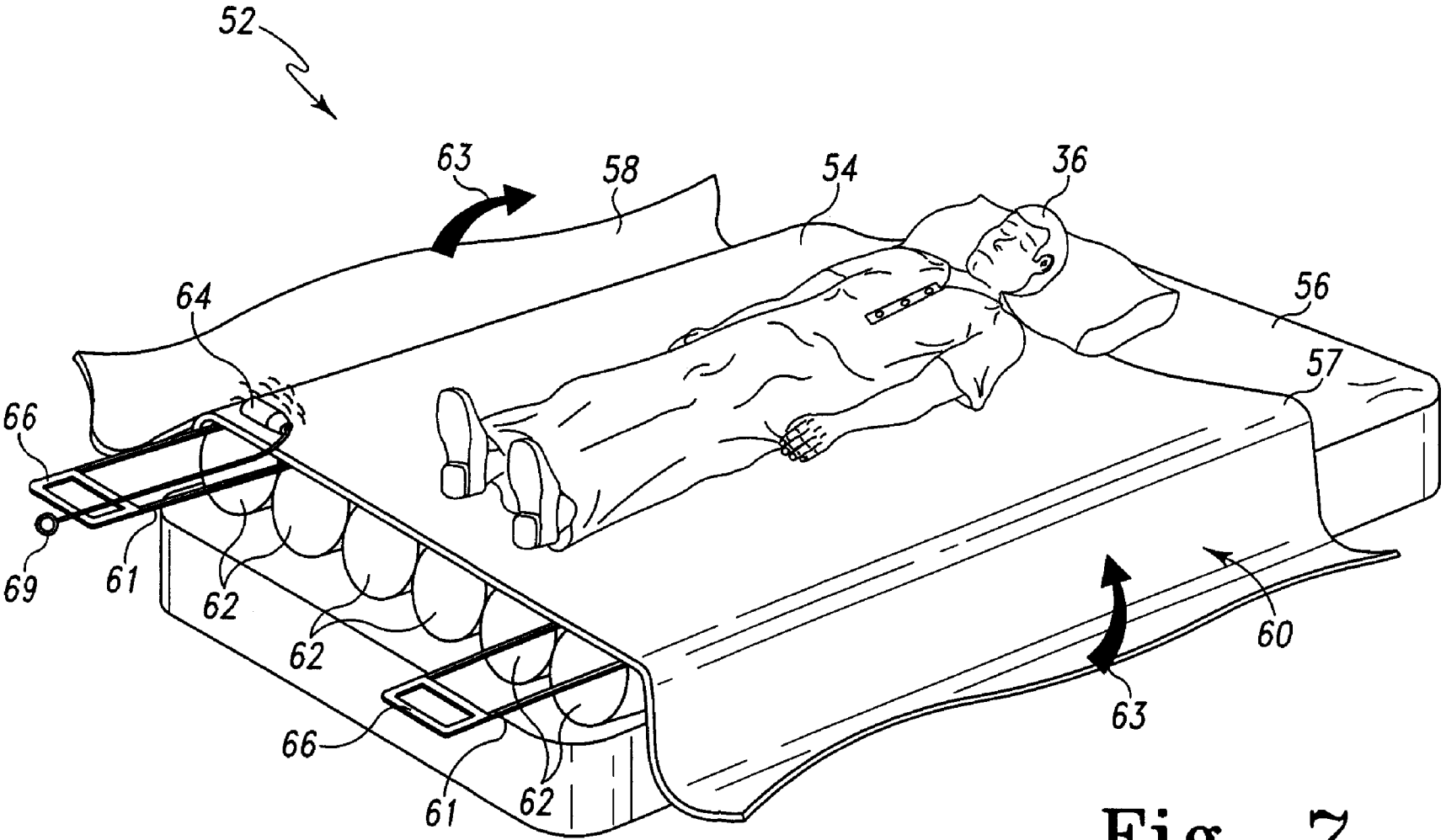
FIG. 7 is a perspective view of the mattress of FIG. 6 after patient removal procedures are initiated, showing the bladders of the patient removal system inflated and the side extensions untucked from beneath the mattress to be wrapped around the patient.

As can be seen in FIG. 7, transporter 54 illustratively has an inflated state wherein bladders 62 are inflated to lift patient 36 relative to mattress 56. Such inflation is illustratively triggered by the actuation of a pressurized cartridge 64. Actuation may occur by a caregiver pulling cord 69, however, other embodiments and methods of inflation are within the scope of the disclosure. For example, a battery powered blower, pump, compressor or other such pressure generator may be used to inflate bladder 62. A blower 78 can be seen in the embodiment shown in FIG. 9.

Flaps 58, 60 illustratively have a tucked-in, non-use position, shown in FIG. 6, and an untucked, use position shown in FIG. 7. Illustratively, such flaps 58, 60 are pulled out from underneath mattress 56 as a result of the inflation of bladders 62. However, it is within the scope of the disclosure to utilize longer flaps 58, 60 that would necessitate assistance from a caregiver pulling them in the direction indicated by arrows 63 in order to untuck them from underneath the mattress.

Figure 8:
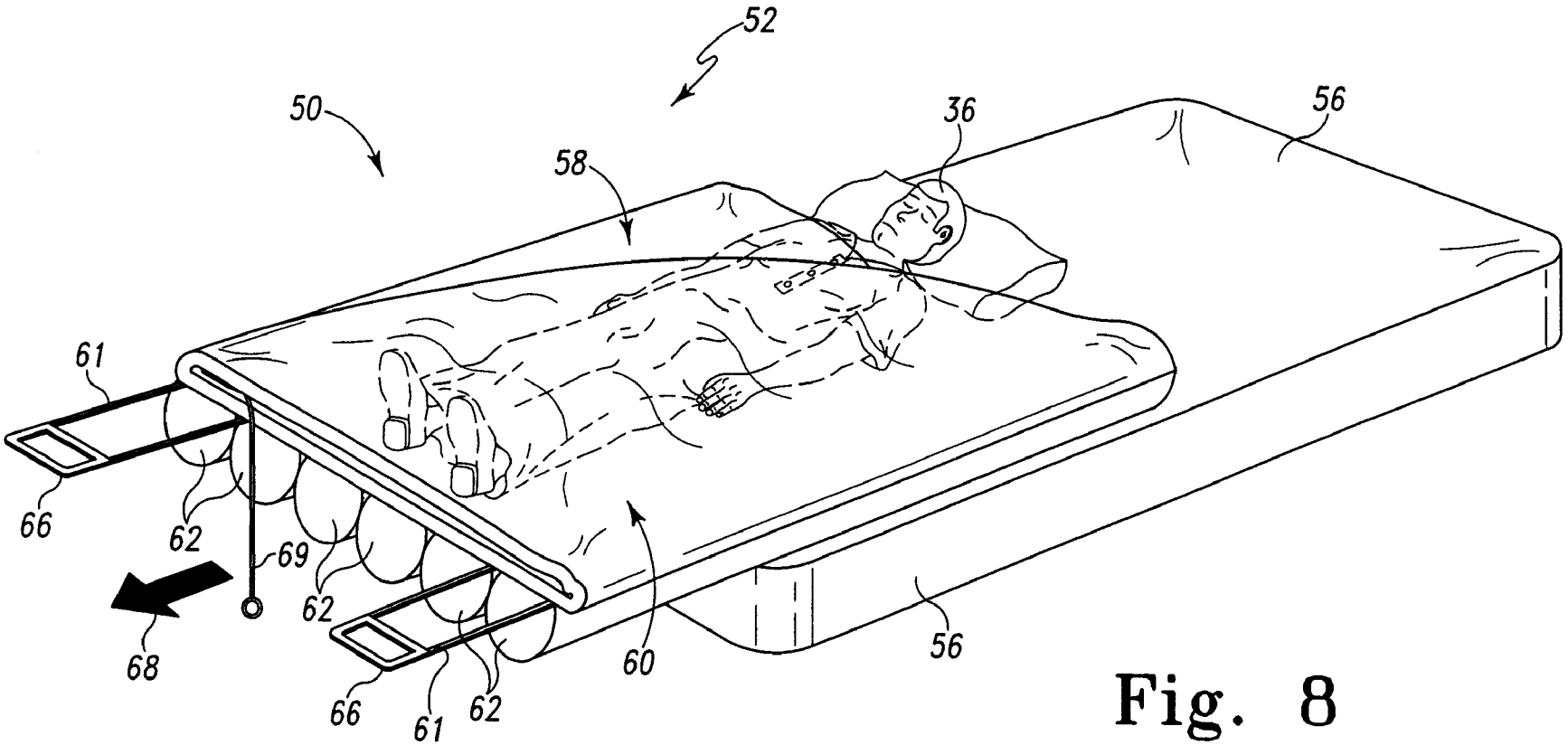
FIG. 8 is a perspective view of the patient removal system of FIGS. 6 and 7, showing the side extensions wrapped around the patient to secure the patient atop the inflated bladders.

As can be seen in FIG. 8, flaps 58, 60 are used to cover patient 36, thereby retaining patient 36 on the transporter 54 during transport. Fasteners, such as snaps, hook-and-loop fasteners (i.e. VELCRO® fasteners), and the like may be provided at appropriate locations on sheet 57 to secure flaps 58, 60 around the patient 36. Handles 66 facilitate the operation and transportation of patient removal system 52. When a caregiver pulls handles 66 and therefore pulls transporter 54 in the direction indicated by arrow 68, patient 36 can be evacuated from the area and removed from the underlying mattress 56. Handles 66 are coupled to sheet 57 by tethers 61. Tethers 61 are sufficiently long to permit the caregiver to grasp handles 66 while standing or leaning over only slightly when transporter 54 is on the floor. If desired, handles 66 and tethers 61 may be tucked beneath sheet 57 or mattress when transporter 54 is not in use.

Figure 9:
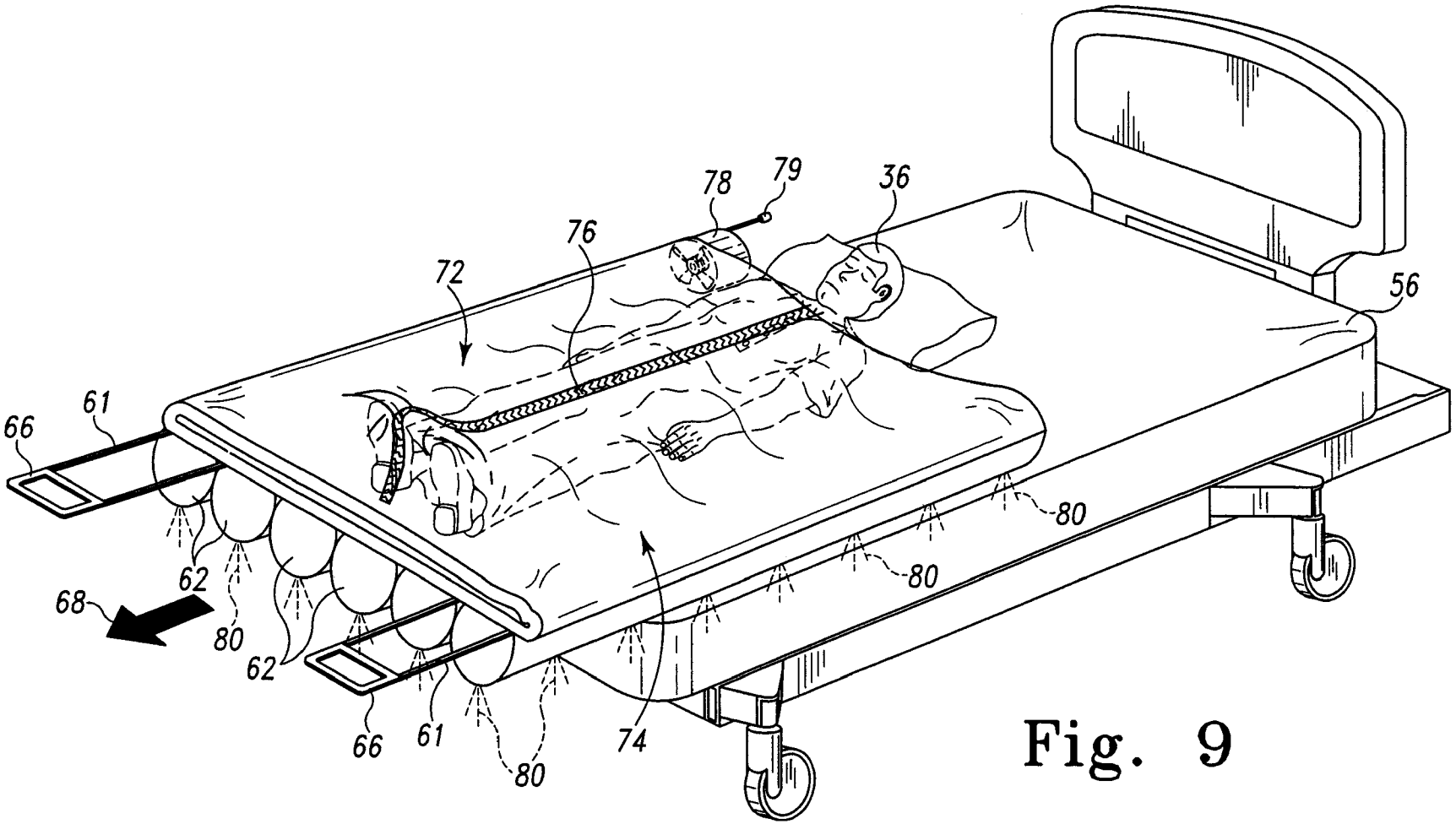
FIG. 9 is yet another embodiment of a patient removal system, similar to the patient removal system of FIG. 6-8, wherein the patient is secured atop a set of inflated bladders with a zippered enclosure.

An alternative embodiment of a transporter 70 is shown in FIG. 9. Transporter 70 includes flaps 72, 74, which can be coupled together by a zipper 76 to form an enclosure around patient 36. Additionally, as can be seen in FIG. 9, a blower 78 may be utilized during transport to maintain the inflation of bladders 62. Blower 78 is illustratively actuated with a pull cord 79. Bladders 62 may include air outlets (not shown) which are provided in spaced relationship along the bottom of bladders 62 and through which pressurized air is expelled as indicated by sets of dotted lines 80 in FIG. 9. The air 80 expelled from the air outlets facilitate the removal of the transporter 70 from the mattress 56, and facilitate movement of transporter 70 over other surfaces such as floors by creating an air bearing between transporter 70 and floor. Such air outlets are low air loss orifices in some embodiments.

Figure 10:
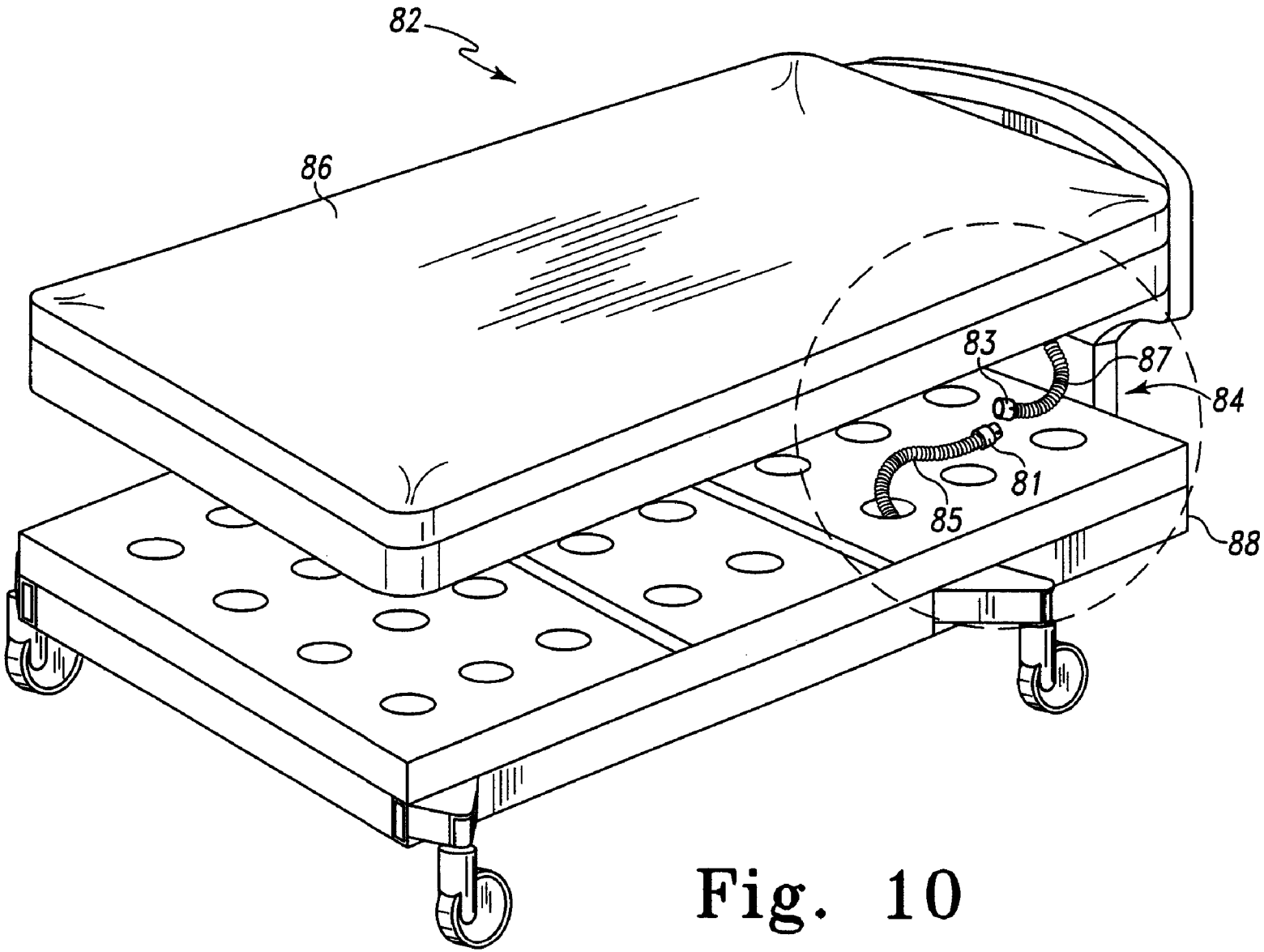
FIG. 10 is a perspective view showing a breakaway pneumatic hose assembly having a first portion extending downwardly relative to a mattress and a second portion extending upwardly from a support deck of a hospital bed.
Figure 11:
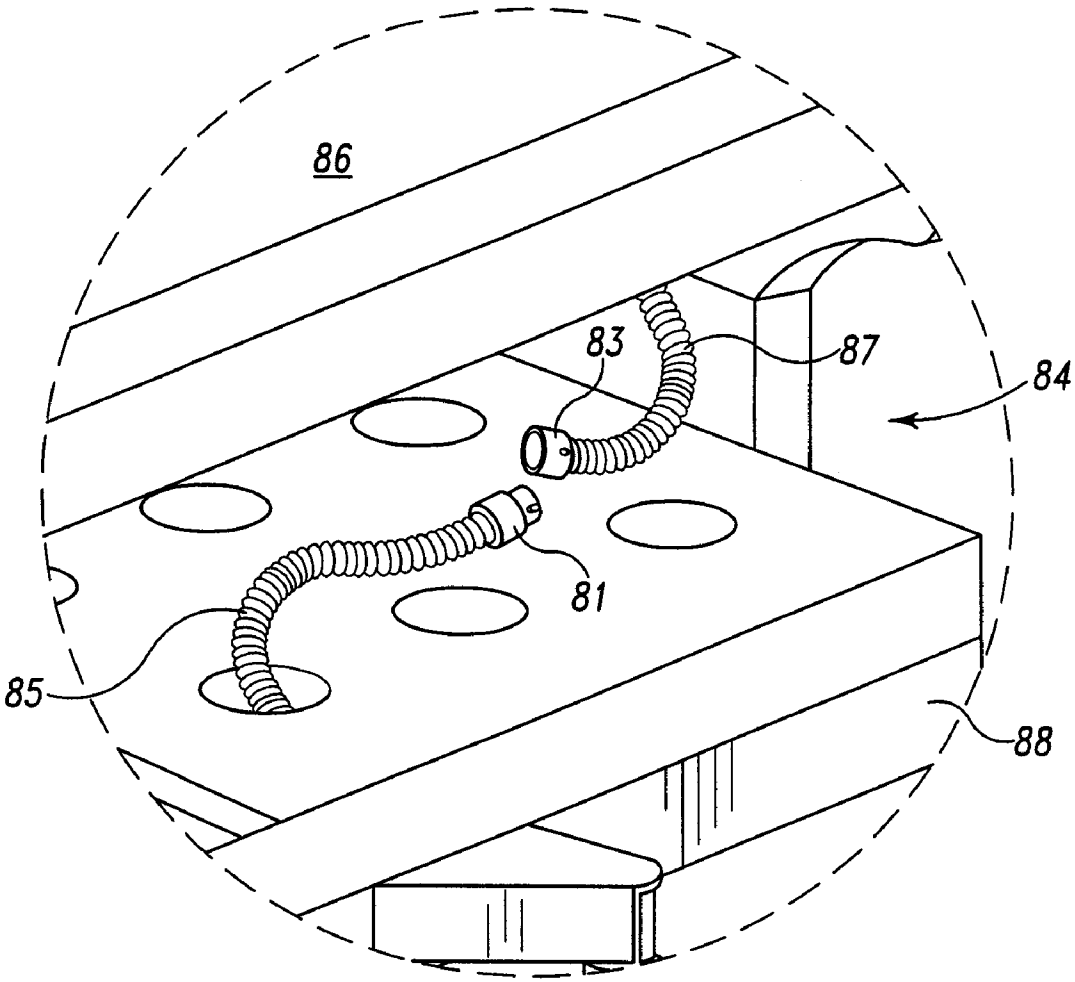
FIG. 11 is a partial, enlarged view of the breakaway pneumatic hose assembly of FIG. 10.

In another embodiment shown in FIG. 10 (and in an enlarged view in FIG. 11), a patient removal system 82 includes a breakaway pneumatic hose assembly 84. Hose assembly 84 is coupled at one end to a pressure generator or other portion of the pneumatic system of the associated bed and is coupled at the other end to an air mattress 86, a transporter, or any other patient support device or the like (hereinafter "mattress") requiring pressurized air in use. Illustrative hose 84 includes a first conduit 85 coupled to the pressure generator or pneumatic system of the bed and a second conduit 87 coupled to the mattress 86. The first conduit 85 is separable from the second conduit 87 with some force, such separation illustratively causing a check valve (not shown) to inhibit the escape of compressed air from mattress 86, thereby maintaining inflation in mattress 86 after it has been removed from contact with the pressure generator. A pneumatic coupler 81 provided at the end of conduit 85 mates with a pneumatic coupler 83 provided at the end of conduit of 87 under normal operating conditions. However, coupler 83 disconnects automatically from coupler 81 when mattress 86 is pulled off of a frame 88 of the bed. The check valve which prevents deflation of mattress 86 is housed within coupler 83 in some embodiments.

The breakaway pneumatic hose assembly 84 is illustratively disposed between the patient support device frame 88 and the mattress 86, however, it is within the scope of the disclosure to position the hose assembly within or adjacent to the mattress 86, or within the patient support device frame 88. Accordingly, when mattress 86 is removed during a patient removal procedure, the breakaway system 84 separates, the check valve closes, and the mattress 86 remains substantially inflated as it is transported away with the patient. Breakaway pneumatic hose assembly 84 may be used in conjunction with any of the patient removal systems disclosed herein.

Figure 12:
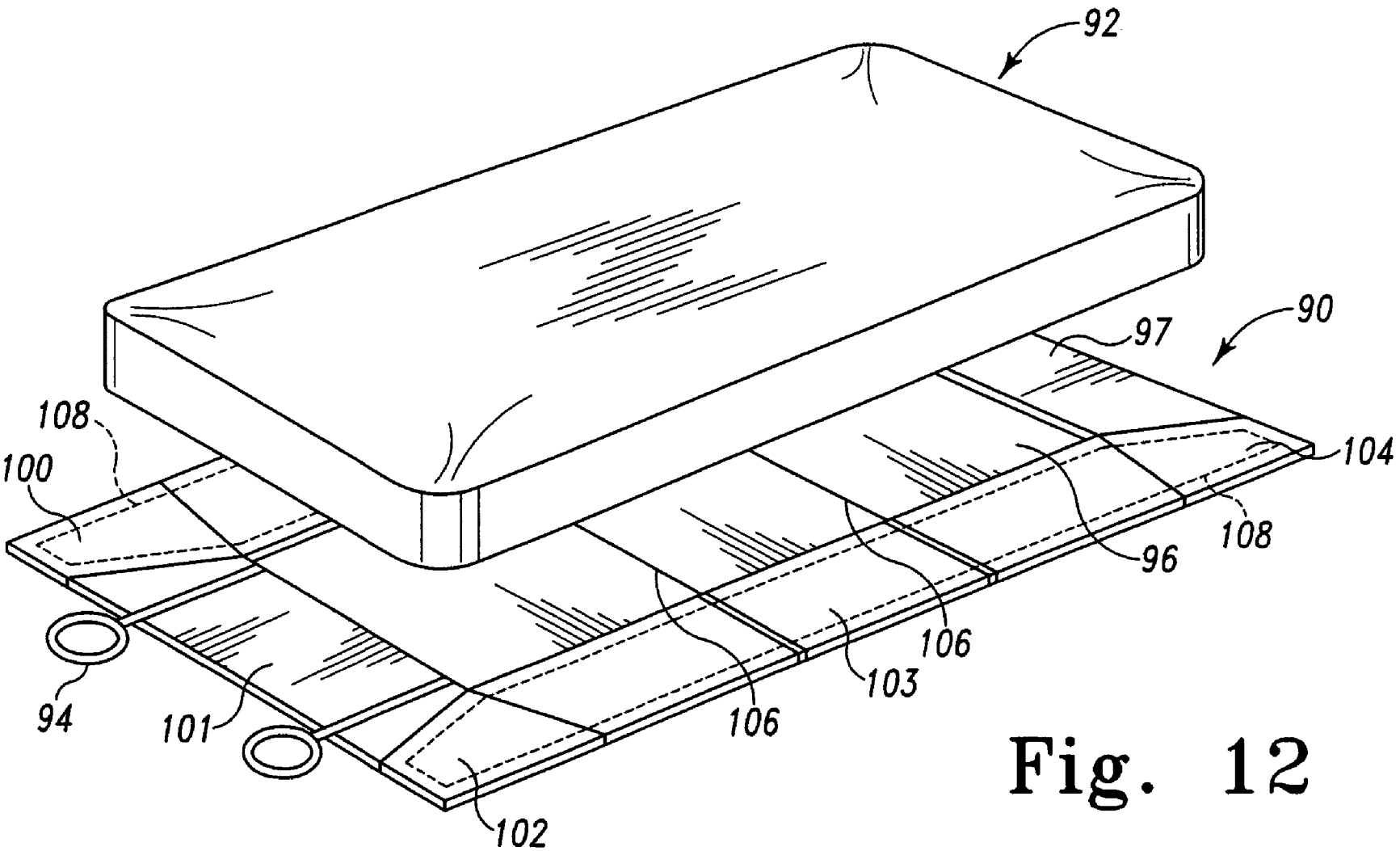
FIG. 12 is a perspective view of yet another embodiment of a patient removal system showing an underlay that can be moved from a substantially planar shape to a three-dimensional partial enclosure.
Figure 13:
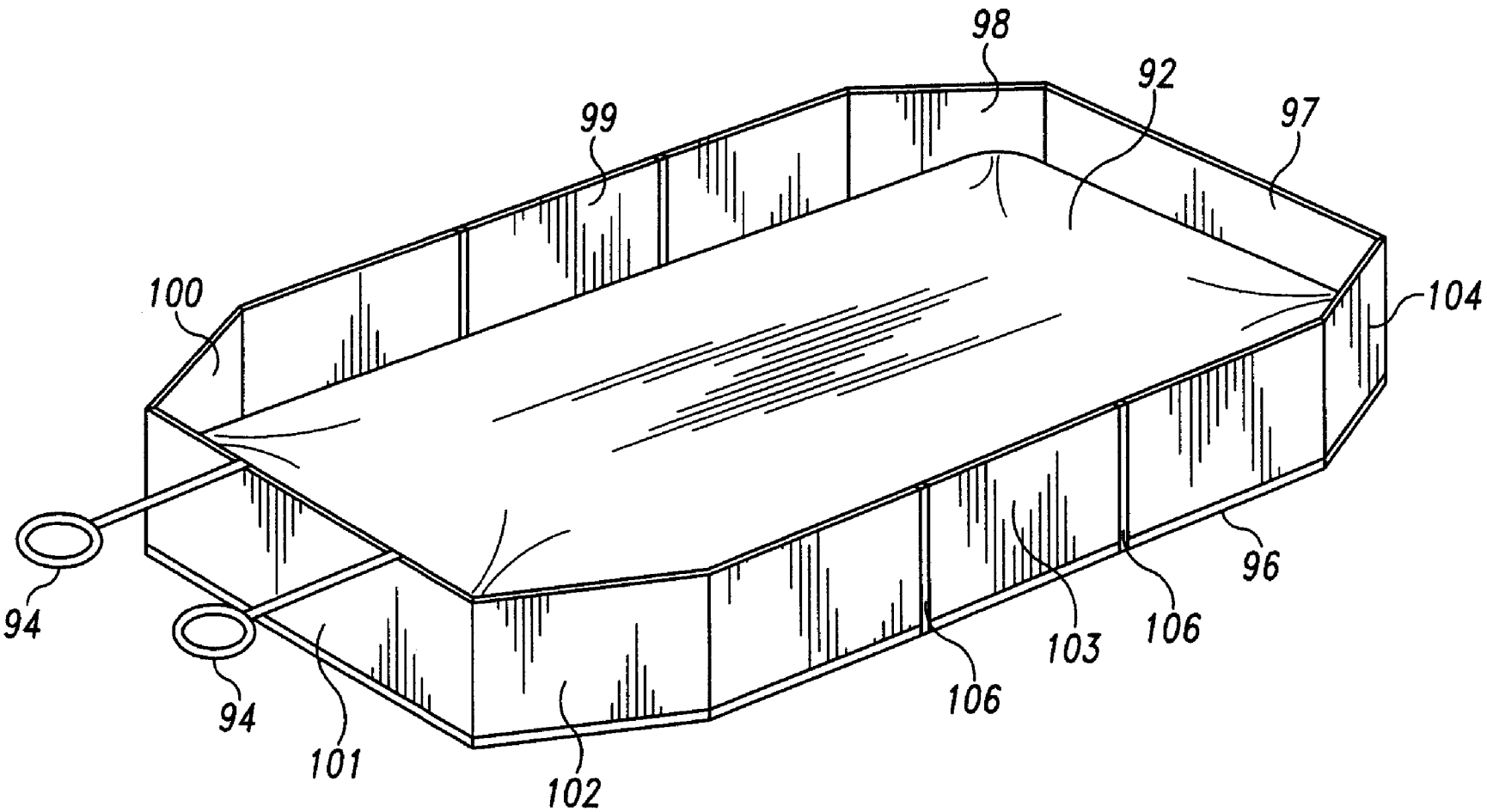
FIG. 13 is a perspective view of the patient removal system of FIG. 12 showing the three-dimensional enclosure encompassing the periphery of the mattress for use during evacuation of the patient.
Figure 14:
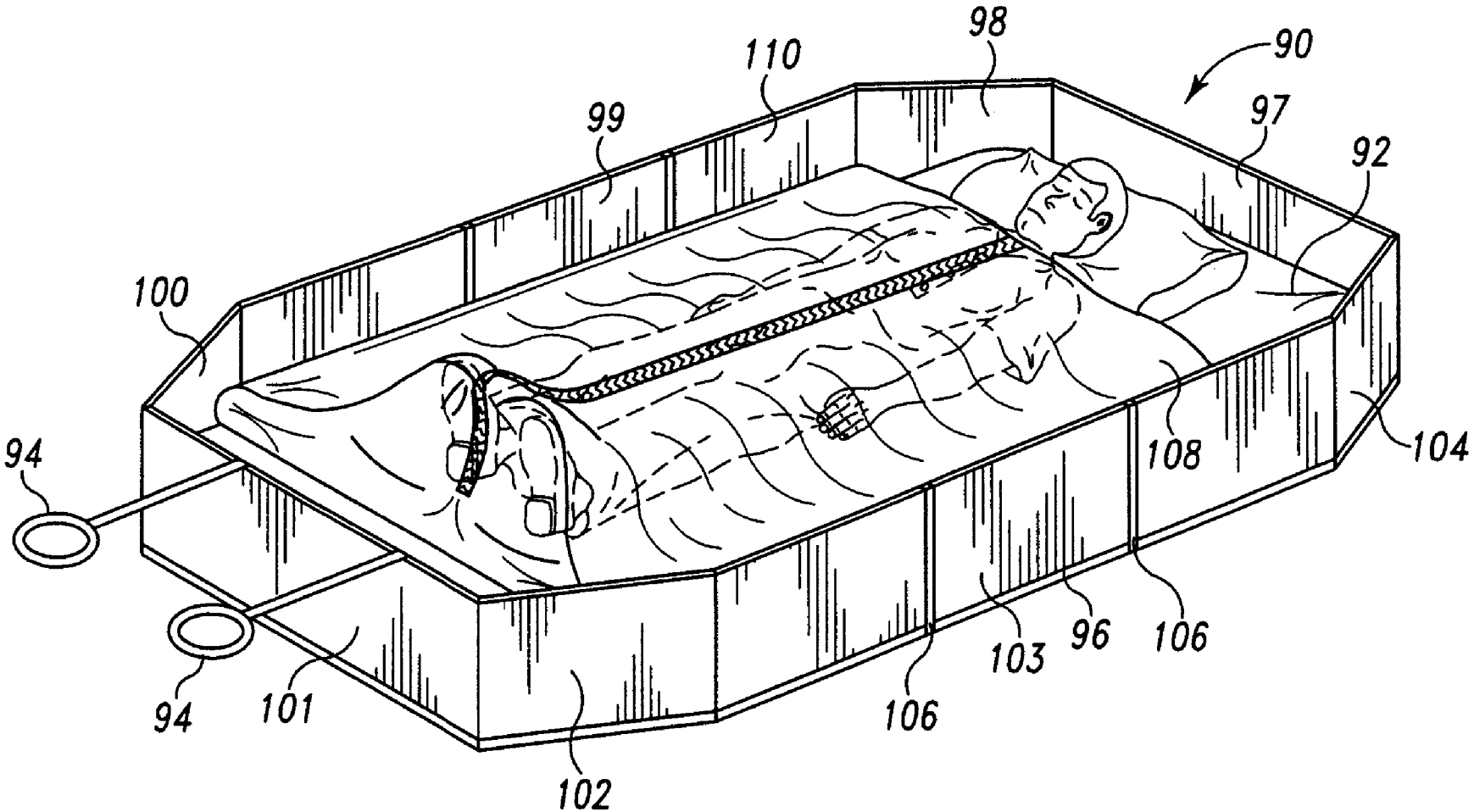
FIG. 14 is a perspective view of the patient removal system of FIGS. 12-13, showing the patient on board the patient removal system, secured by a zippered wrap.

In yet another embodiment shown in FIGS. 12-14, a patient removal system includes an underlay 90 that is positioned under a mattress 92 or other support device for actuation during a patient removal procedure. During normal use of the patient support device in a patient care setting, the underlay is folded into a substantially planar shape and positioned under the mattress 92, illustratively with two activation handles 94 extending beyond the periphery of the mattress 92. It should be understood, of course, that other underlay constructions are within the scope of this disclosure. For example, any number of handles 94 or no handles may be included in underlay 90, or the handles 94 may be accessible from under the mattress, rather than extending beyond the periphery of the mattress.

Illustratively, upon actuation of handles 94 by pulling, underlay 90 moves into a configuration forming a three-dimensional carrier that has a base 96 and walls 97, 98, 99, 100, 101, 102, 103 and 104 as shown in FIG. 13. Walls 97, 98, 99, 100, 101, 102, 103 and 104 are illustratively interconnected and moved into place with a cinch strap (not shown) that is connected to handles 94, however, other embodiments are within the scope of the disclosure. Illustratively, walls 97, 101 are parallel and form head and foot end walls adjacent to ends of a mattress 92, as shown in FIG. 14, and walls 99, 103 are parallel and form side walls adjacent to sides of mattress 92. The illustrative comer walls 98, 100, 102, and 104 are disposed at obtuse included angles to walls 97, 99, 101, and 103.

The top edges of each of walls 97, 98, 99, 100,101, 102, 103, 104 are at a higher elevation than the upper surface of mattress 92 when underlay is in the carrier-forming configurations shown in FIGS. 13 and 14. Thus, walls 97, 98, 99, 100,101, 102, 103, 104 extend upwardly beyond the upper surface of mattress 92 when underlay is used to transport mattress 92 and the patient thereon, thereby providing barriers to inhibit the patient from falling off of mattress 92 during emergency transport.

Illustratively, underlay 90 may be formed of plastic, corrugated plastic, or a similar material having the strength to contain a patient during transport and to withstand transport of the patient and underlay. Illustratively, the underlay also supports mattress 92 during transport. Further illustratively, walls 99, 103 and base 96 may have flex lines 106 or score lines that can accommodate patient support devices that articulate or otherwise move into non-planar positions during normal operation, therefore requiring bending of the underlay. The use of corrugated material provides rigidity in one direction and more flexibility in another.

As illustrated in FIG. 14, a wrap 108 for securing the patient could be provided with underlay 90. Such a wrap 108 could be folded or embedded with the underlay 90 (visible in phantom in FIG. 12) in the non-use position, to be wrapped around the patient upon actuation of underlay 90. Illustratively, the wrap 108 may have a zipper 110 or other securing device to assist with securing the patient during transport.

While the devices disclosed herein are susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure as defined by the appended claims.

There is a plurality of advantages of the present invention arising from the various features of the devices described herein. It will be noted that alternative embodiments of the patient removal system of the present invention may not include all of the features described yet still benefit from at least some of the advantages of such features. Those of ordinary skill in the art may readily devise their own implementations of a patient removal system that incorporate one or more of the features of the present invention and fall within the spirit and scope of the present invention as defined by the appended claims.

The invention claimed is:

1. A system for removing a patient from a patient support device having a deck and a mattress supported thereon, the system comprising:

a transporter to be positioned between the patient and the mattress, the transporter comprising an inflatable portion that inflates to a transport position to lift the patient relative to the mattress and to facilitate removal of the transporter with the patient thereon from the mattress, wherein the inflatable portion comprises a plurality of side-by-side, elongated bladders oriented along a longitudinal length of the transporter and situated beneath the patient, and a set of handles coupled to the transporter and configured to be gripped by a caregiver when removing the transporter from the mattress, wherein the set of handles are also usable to actuate inflation of the inflatable portion of the transporter.

2. The system of claim 1, wherein the transporter comprises a sheet to wrap around a portion of the mattress in a non-use position, the sheet being further configured to wrap around at least a portion of the patient during transport.

3. The system of claim 1, wherein the bladders comprise a plurality of air outlets from which air is expelled downwardly.

4. The system of claim 1, further comprising a pressurized air source coupled to the transporter.

5. The system of claim 4, wherein the pressurized air source comprises one of a blower, a pump, and a compressor.

6. The system of claim 4, further comprising a battery coupled to the transporter, the battery powering the pressurized air source.

7. The system of claim 1, wherein the handles are coupled to a foot end of the transporter.

8. The system of claim 1, wherein the handles are coupled to the transporter by tethers that have sufficient length to permit the handles to be tucked beneath the mattress when the inflatable portion of the transporter is deflated.

9. The system of claim 1, wherein the transporter further comprises a sheet, the inflatable portion is coupled to a central region of the sheet, and the sheet has flaps extending from each side of the central region.

10. The system of claim 9, wherein the flaps are sized such that portions of the flaps can be tucked underneath the mattress when the inflatable portion of the transporter is deflated and such that the flaps automatically untuck from beneath the mattress when the inflatable portion is inflated.

11. The system of claim 9, wherein the transporter further comprises fasteners to couple flaps together to retain the patient on the transporter during transport.

12. The system of claim 11, wherein the fasteners comprises at least one of snaps, hook-and-loop material, and zippers.

13. The system of claim 1, wherein the transporter further comprises a pressurized air cartridge to inflate the inflatable portion.

14. The system of claim 13, wherein the transport further comprises a cord that is pulled to actuate the pressurized air cartridge.

15. A system for removing a patient from a patient support device having a deck and a mattress supported thereon, the system comprising:

a transporter to be positioned between the patient and the mattress, the transporter comprising an inflatable portion that inflates to a transport position to lift the patient relative to the mattress and to facilitate removal of the transporter with the patient thereon from the mattress, wherein the transporter further comprises a sheet, the inflatable portion is coupled to a central region of the sheet, and the sheet has flaps extending from each side of the central region, wherein the flaps are sized such that portions of the flaps can be tucked underneath the mattress when the inflatable portion of the transporter is deflated and such that the flaps automatically untuck from beneath the mattress when the inflatable portion is inflated, wherein the transporter further comprises fasteners to couple flaps together to retain the patient on the transporter during transport, further comprising handles coupled to the transporter, wherein movement of the handles actuates inflation of the inflatable portion of the transporter.

16. The system of claim 15, further comprising one of an air cartridge, a blower, a pump, and a compressor which is operable to inflate the inflatable portion.

17. The system of claim 15, further comprising handles coupled to the transporter.

18. The system of claim 15, wherein the inflatable portion has a plurality of air outlets from which air is expelled downwardly.

* * * * *